US011274519B1

(12) United States Patent
Helms et al.

(10) Patent No.: US 11,274,519 B1
(45) Date of Patent: Mar. 15, 2022

(54) REVERSE CEMENTING TOOL

(71) Applicant: Halliburton Energy Services, Inc., Houston, TX (US)

(72) Inventors: Lonnie Carl Helms, Houston, TX (US); Jinhua Cao, Houston, TX (US); Handoko Tirto Santoso, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/138,336

(22) Filed: Dec. 30, 2020

(51) Int. Cl.
*E21B 33/14* (2006.01)
*E21B 34/06* (2006.01)

(52) U.S. Cl.
CPC ..... *E21B 33/14* (2013.01); *E21B 34/06* (2013.01); *E21B 2200/04* (2020.05)

(58) Field of Classification Search
CPC ..... E21B 33/14; E21B 34/06; E21B 2200/04
See application file for complete search history.

(56) References Cited

U.S. PATENT DOCUMENTS 2,429,912 A * 10/1947 Baker ..... E21B 33/14 137/496
3,948,322 A 4/1976 Baker
4,674,569 A * 6/1987 Revils ..... E21B 34/14 166/154
5,279,370 A 1/1994 Brandell et al.
5,647,434 A 7/1997 Sullaway et al.
5,765,641 A 6/1998 Shy et al.
6,026,903 A 2/2000 Shy et al.
6,244,342 B1 * 6/2001 Sullaway ..... E21B 21/10 166/285
6,802,373 B2 10/2004 Dillenbeck et al.
7,857,052 B2 12/2010 Giroux et al.
8,215,404 B2 * 7/2012 Makowiecki ..... E21B 34/14 166/332.1
8,616,276 B2 12/2013 Tips et al.
8,646,537 B2 2/2014 Tips et al.
8,720,561 B2 5/2014 Zhou
8,800,655 B1 * 8/2014 Bailey ..... E21B 33/146 166/289
9,010,442 B2 4/2015 Streich et al.
9,291,007 B2 3/2016 Darbe et al.
(Continued)

FOREIGN PATENT DOCUMENTS

EP 1262629 A1 12/2002
EP 2826951 A2 1/2015

OTHER PUBLICATIONS

Halliburton Brochure, "Cementing ES II Stage Cementer," Feb. 2009.

(Continued)

*Primary Examiner* — Matthew R Buck
(74) *Attorney, Agent, or Firm* — McAfee & Taft

(57) ABSTRACT

A reverse cementing tool has an outer case connected in a casing string. A dual stage actuating sleeve is disposed in the outer case and is operable in a first stage actuation to open a cement flow path from a well annulus to a central flow passage of the reverse cementing tool. In a second stage actuation the cement flow path is closed. The actuating sleeve includes inner and outer sleeves in the outer case. The inner and outer sleeves move in opposite directions in the outer case to first open, and then close the cement flow path.

18 Claims, 5 Drawing Sheets

(56) References Cited

U.S. PATENT DOCUMENTS

| | | | | |
|---|---|---|---|---|
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 * | 11/2017 | Lirette | E21B 34/12 |
| 9,920,620 | B2 | 3/2018 | Murphree et al. | |
| 10,024,150 | B2 | 7/2018 | Andreychuk et al. | |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 2006/0207765 | A1 | 9/2006 | Hofman | |
| 2009/0095486 | A1 | 4/2009 | Williamson, Jr. | |
| 2009/0151960 | A1 | 6/2009 | Rogers et al. | |
| 2013/0048290 | A1 | 2/2013 | Howell et al. | |
| 2016/0208578 | A1 | 7/2016 | Guzman et al. | |
| 2018/0030824 | A1 | 2/2018 | Roberson et al. | |
| 2019/0017366 | A1 | 1/2019 | Alaas et al. | |
| 2019/0249549 | A1 | 8/2019 | Fripp et al. | |

OTHER PUBLICATIONS

Halliburton Brochure, "Fidelis Stage Cementer," Sep. 2013.
Halliburton Catalog titled "Casing Equipment" (2015), entire catalog.
International Search Report and Written Opinion dated Apr. 5, 2021, issued in PCT Application No. PCT/US2020/053694.
International Search Report and Written Opinion dated Nov. 12, 2021, issued in corresponding PCT Application No. PCT/US2021/044170.

* cited by examiner

REVERSE CEMENTING TOOL

BACKGROUND

It is common in the oil and gas industry to cement casing in wellbores. Generally, a wellbore is drilled and a casing string is inserted into the wellbore. Drilling mud and/or a circulation fluid is circulated through the annulus and the casing inner diameter to flush excess debris from the well. In a conventional circulation method cement is then pumped into the annulus between the casing and the wellbore.

In a second method, the cement composition slurry is pumped directly down the annulus and into the casing. This is called reverse-circulation cementing. In reverse-circulation cementing, the leading edge of the cement slurry must be monitored to determine when it enters the casing so that the cement does not fill the casing to an undesirable level. Unwanted cement that enters the casing must be drilled out of the casing at a significant cost. The drill out procedure may be avoided by stopping the flow of cement once an indication that cement has entered the casing is received.

DESCRIPTION OF AN EMBODIMENT

Figure 1:
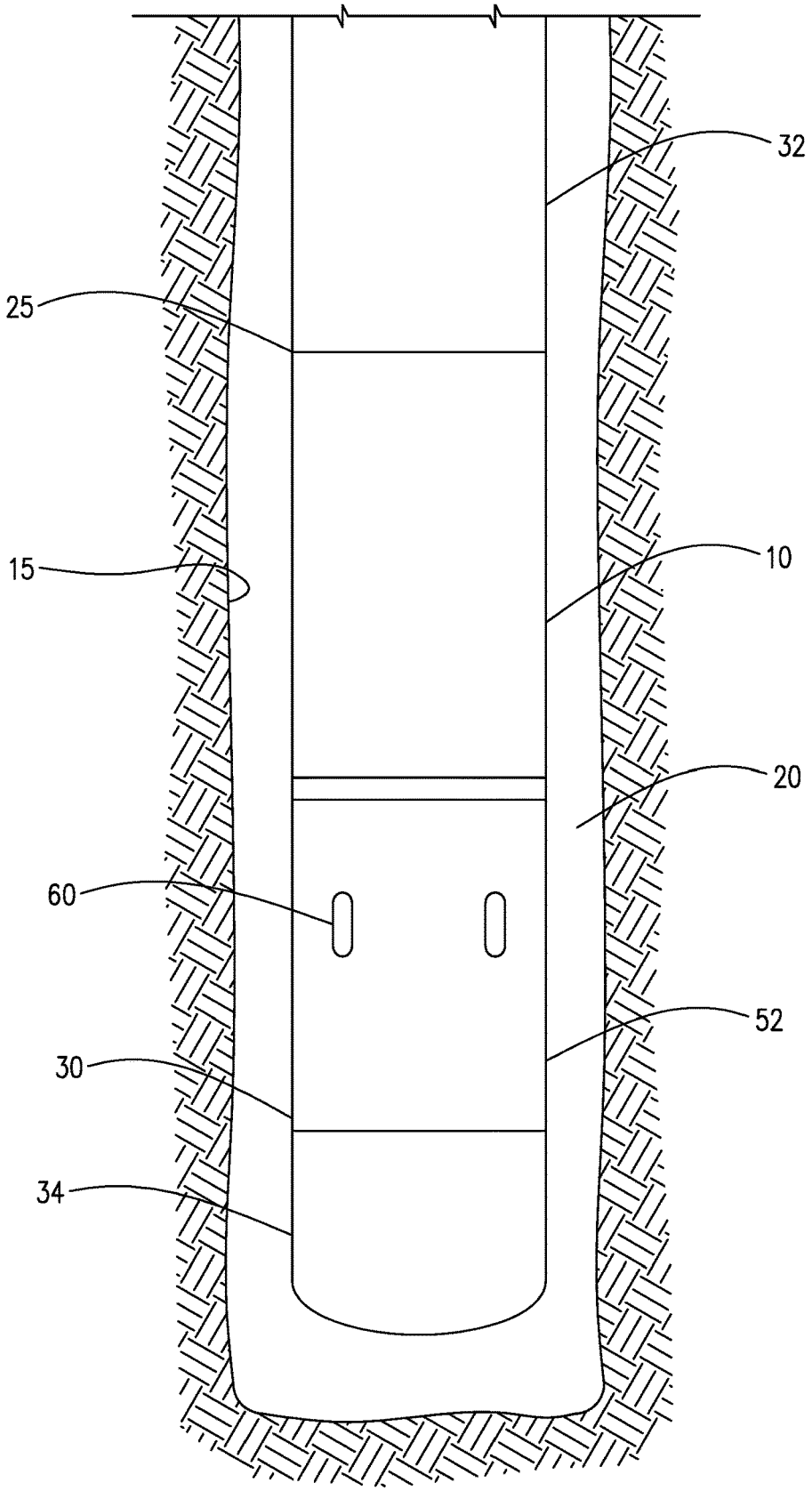
FIG. 1 is a schematic of a cementing tool lowered into a well.

A cementing tool 10 is shown lowered into a wellbore 15. Reverse cementing tool 10 is being lowered into a wellbore 15 on a casing 32. Cementing tool 10 has an upper end 25 that may be connected in casing 32 and a lower end 30 that may be connected in casing 32 or may have for example a poppet valve, such as a float shoe 34 connected thereto. Cementing tool 10 defines a central flow passage 31 therethrough.

Float shoe 34 may be of a type known in the art that utilizes an autofill strap 36 with beads 38 in a lower end thereof. Beads 38 may be positioned between a valve element 40 of float shoe 34 and a sealing surface 42 to create a space therebetween so that when lowered into the wellbore fluid from wellbore 15 may fill casing 32. An annulus 20 is defined by and between reverse cementing tool 10 and wellbore 15.

Figure 2:
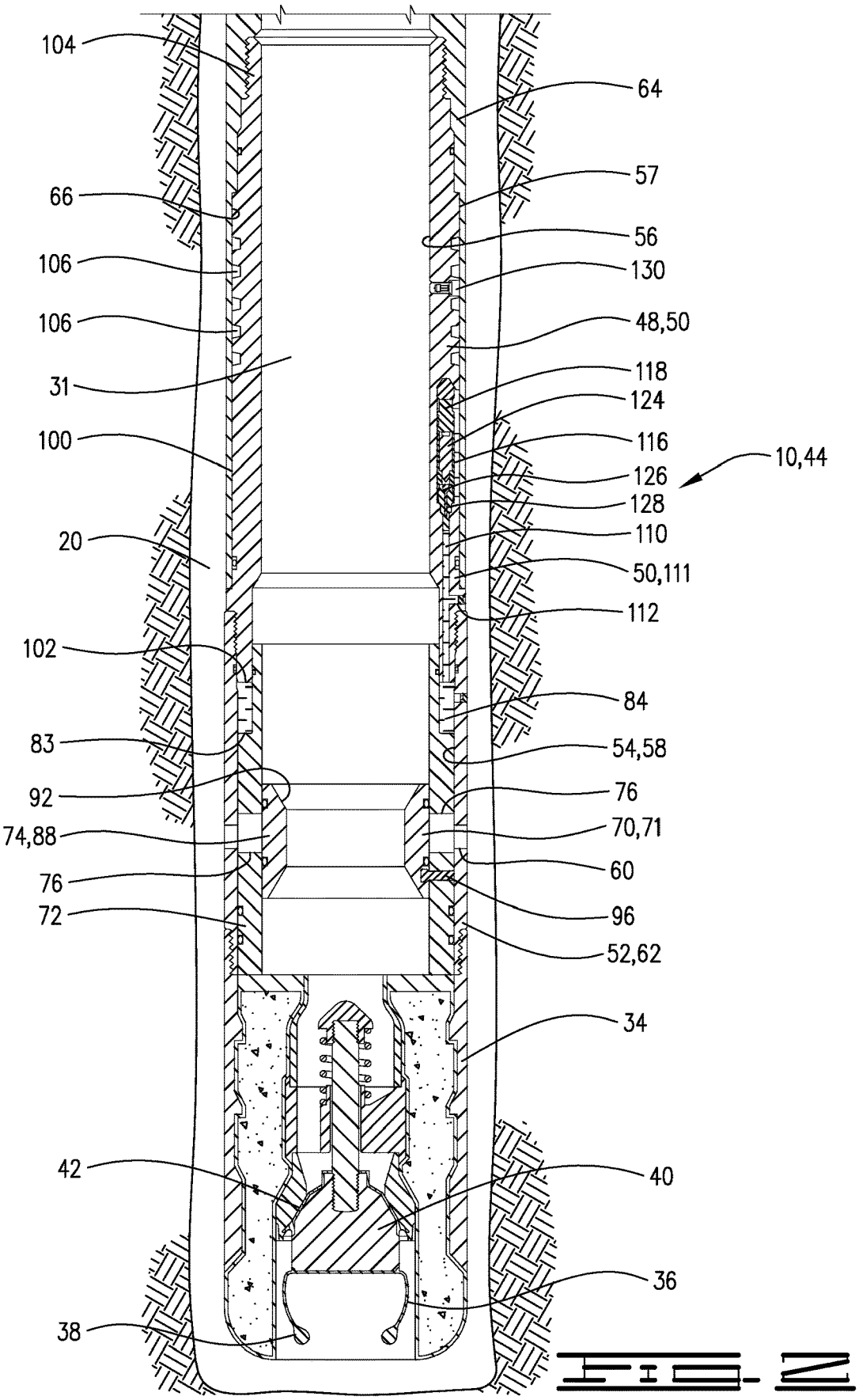
FIG. 2 is a cross section of a cementing tool in a run-in position.
Figure 3:
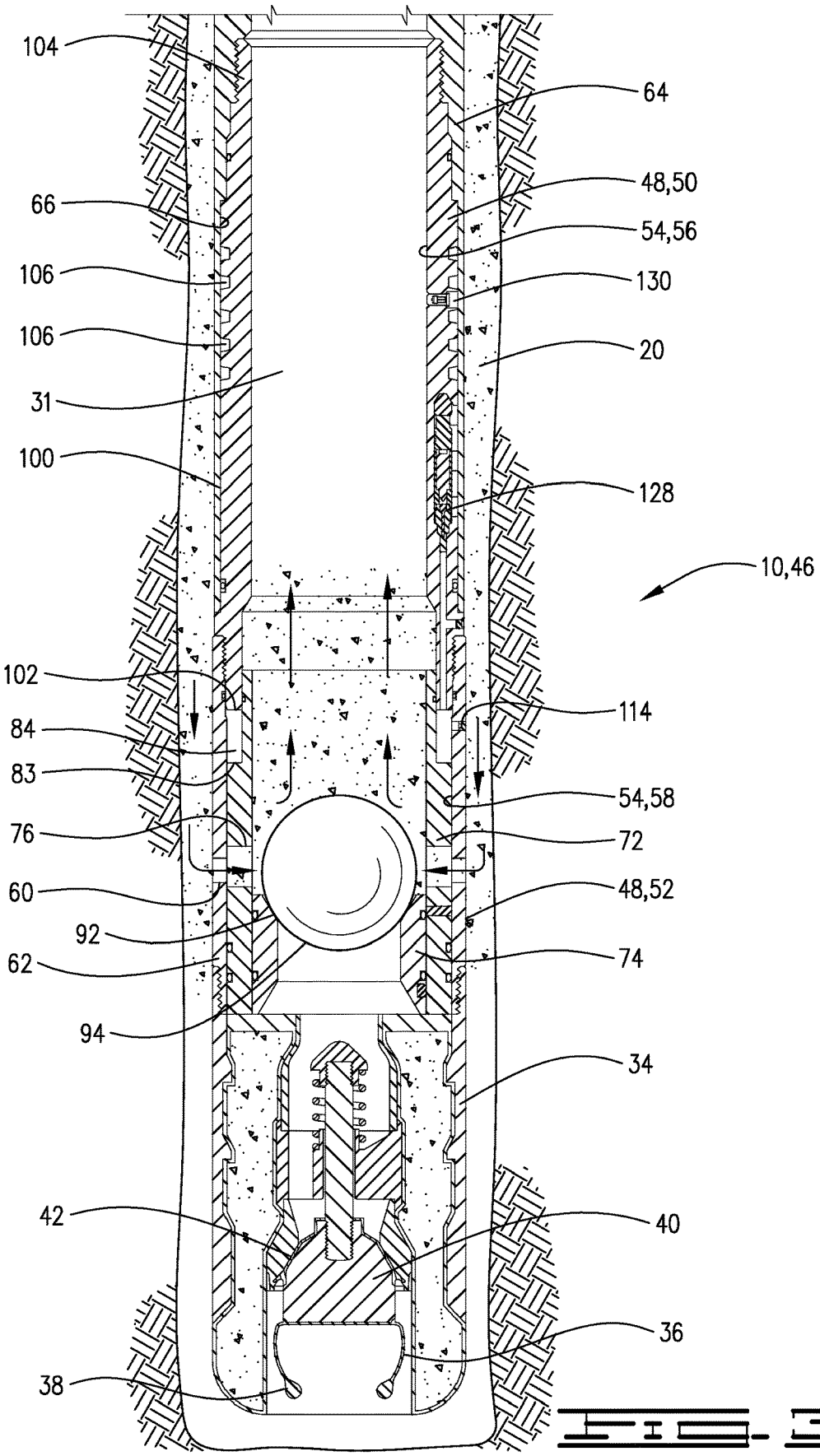
FIG. 3 is a cross section of the cementing tool in a cementing position.
Figure 4:
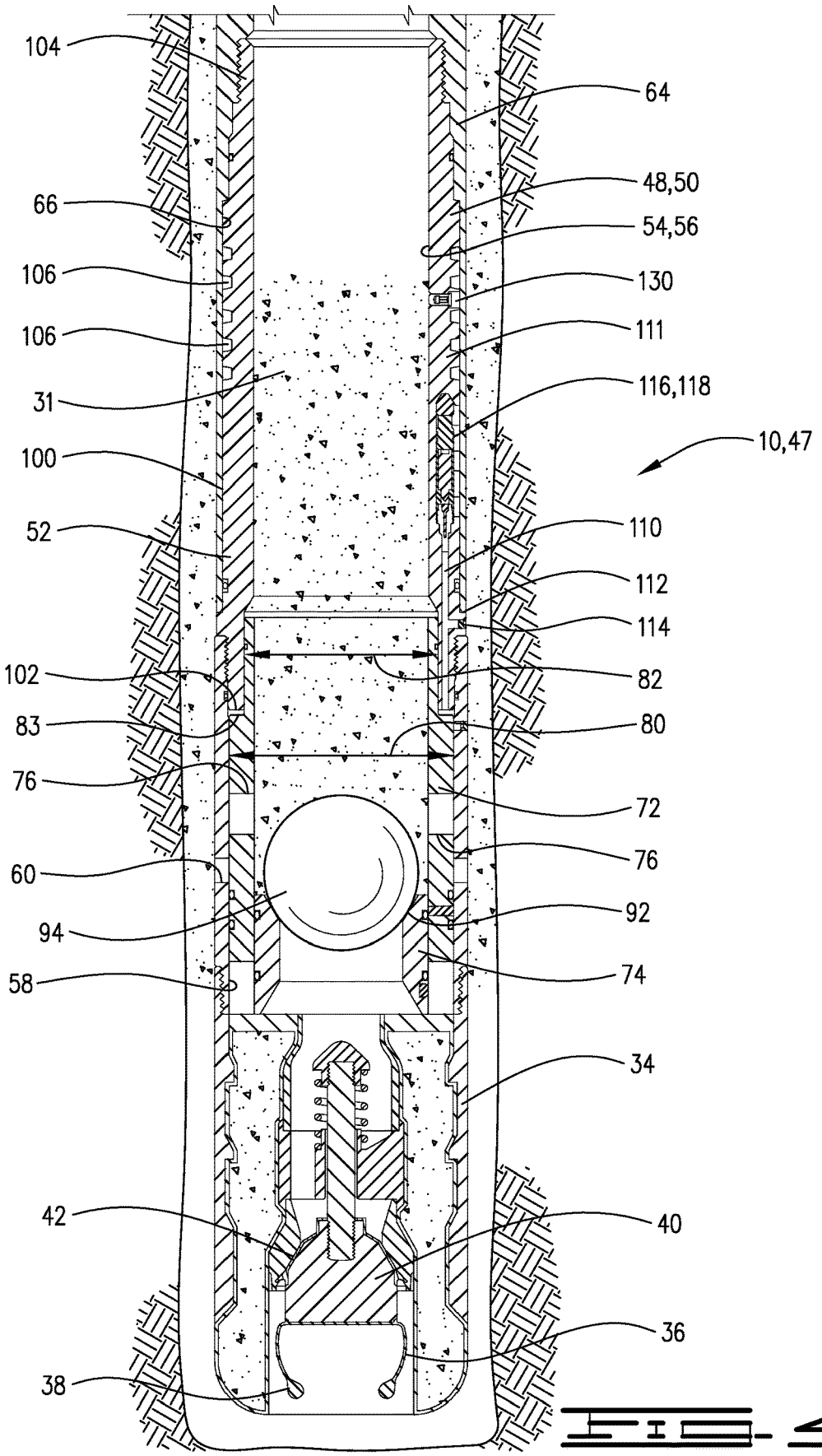
FIG. 4 is a cross section of the cementing tool in the completed position.

Reverse cementing tool 10 is shown in a first position 44 in FIG. 2. In the first position 44, the well may be conditioned by pumping fluid through the casing 32 and cementing tool 10 outwardly through float shoe 34 as cementing tool 10 is lowered into wellbore 15. Once the well has been properly conditioned and the reverse cementing tool 10 is in the desired location in the well, the reverse cementing process can begin as will be described in detail herein. Reverse cementing tool 10 has three positions. First position 44 is shown in FIG. 1. In the second position 46 which is shown in FIG. 3, cement may flow downwardly in annulus 20 and upwardly into the central flow passage 31 of reverse cementing tool as indicated by the arrows. In a third position 47 of the reverse cementing tool 10, fluid is not permitted to enter the reverse cementing tool 10 from the annulus 20. The second position 46 may also be referred to as the cementing position and the third position 47 may be referred to as the finished position.

Reverse cementing tool 10 comprises an outer case, or outer housing 48 which may be a tubular outer case 48. Outer case 48 comprises an upper outer case 50 connected to a lower outer case 52. Upper and lower outer cases may be threadedly connected. Outer case 48 defines an inner surface 54 which is comprised of an inner surface 56 on upper outer case 50 and an inner surface 58 on lower outer case 52. A plurality of outer case flow ports 60 are defined through a wall 62 thereof. A coupling sleeve 64 may be connected to outer case 48. Coupling sleeve 64 may connect cementing tool 31 to casing 32. Coupling sleeve 64 has inner surface 66.

A dual stage actuating sleeve 70 is disposed in outer case 48. In the first, or run-in position of the cementing tool 10, dual stage actuating sleeve 70 is in its first position 71 in which flow into housing through outer case flow ports 60 is prevented. Dual stage actuating sleeve comprises an outer sleeve 72 and an inner sleeve 74. Outer sleeve 72 has a plurality of sleeve ports 76 through a wall thereof. Inner sleeve 74 is detachably connected to outer sleeve 72 and once detached is movable relative thereto. Dual stage actuating sleeve 70 is shown in run-in position 44 in FIG. 2. In the run-in position 44 of dual stage actuating sleeve 70, outer sleeve 72 is positioned such that the plurality of sleeve ports 76 are aligned with outer case flow ports 60. Communication between central flow passage 31 and annulus 20 is prevented in the run-in position 44 by inner sleeve 74 which is positioned to block flow through sleeve ports 76.

In a first stage actuation cementing tool 10 moves to the second, or cementing position 46. In the second, or cementing position 46 of dual stage actuating sleeve 70, inner sleeve 74 moves downwardly to permit communication between annulus 20 and central flow passage 31. A cement flow path defined by sleeve ports 76 and outer case flow ports 60 is opened to allow flow therethrough into central flow passage 31 of cementing tool 10. When cementing is complete, a second stage actuation of the cementing tool 10 occurs. Outer sleeve 72 is moved upwardly to the third position 47 of the dual stage actuating sleeve 70 in which flow through outer case flow ports 60 is once again prevented, thus blocking the cement flow path defined by sleeve ports 76 and outer case flow ports 60. In the third position 47 however, flow through outer case flow ports 60 is prevented by outer sleeve 72 as opposed to inner sleeve 74.

Outer sleeve 72 has a first outer diameter 80 which engages inner surface 54 of outer case 48. A second outer diameter 82 is smaller than first outer diameter 80. A shoulder 83 is defined between first and second outer diameters 80 and 82. Outer sleeve 72 defines an annular space 84 with outer case 48 at the second outer diameter 82 of outer sleeve 72. Annular space 84 has fluid therein in the first position 44 of the reverse cementing tool 10, and thus comprises a fluid chamber.

Inner sleeve 74 in the first position 44 of cementing tool 10 is in its first position 88. In its first position 88, inner sleeve 74 blocks sleeve ports 76 and prevents flow therethrough into reverse cementing tool 10 from annulus 20. Inner sleeve 74 is movable to its second position 90 which is the second, or cementing position 46 of reverse cementing tool 10.

Inner sleeve 74 has a seat 92 thereon for receiving a plug or ball 94. Inner sleeve 74 is detachably connected to outer sleeve 72 with a shear pin 96 or other means known in the art. In operation, ball 94 is displaced through the casing and cementing tool 10 until it engages seat 92. Pressure is increased until shear pin 96 breaks allowing inner sleeve 74 to move downwardly into its second position to permit flow through outer case flow ports 60 and sleeve ports 76. The downward movement of inner sleeve 74 is stopped by an upper end of float shoe 34.

Upper outer case 50 has outer surface 100, lower end 102 and upper end 104. Lower end 102 terminates in annular space 84 above shoulder 83. Annular space 84 is a fluid filled annular space. A plurality of grooves 106 are defined in outer surface 100. Grooves 106 define a relief chamber 108 for receiving fluid from fluid filled chamber 84 when cementing tool 10 moves to its third position 47. Relief chamber 108 is an air chamber at atmospheric pressure that will be displaced once the activating assembly 116 is actuated and the rupture disk 128 is punctured as described below. Relief chamber 108 is defined by and between outer case 48 and coupling sleeve 64. More specifically, in the described embodiment, relief chamber 108 is defined by grooves 106 and inner surface 66 of coupling sleeve 64. A fluid relief passageway 110 extends upwardly from lower end 102 of upper outer case 50 in wall 111 thereof. A fill port 112 may be used to fill fluid chamber 84 through relief passageway 110. A plug 114 can be placed in fill port 112. A triggering, or activating assembly 116 is placed in a pocket 118 in wall 111 of upper outer case 50. Pocket 118 is communicated with fluid passageway 110 and relief chamber 118.

Figure 5:
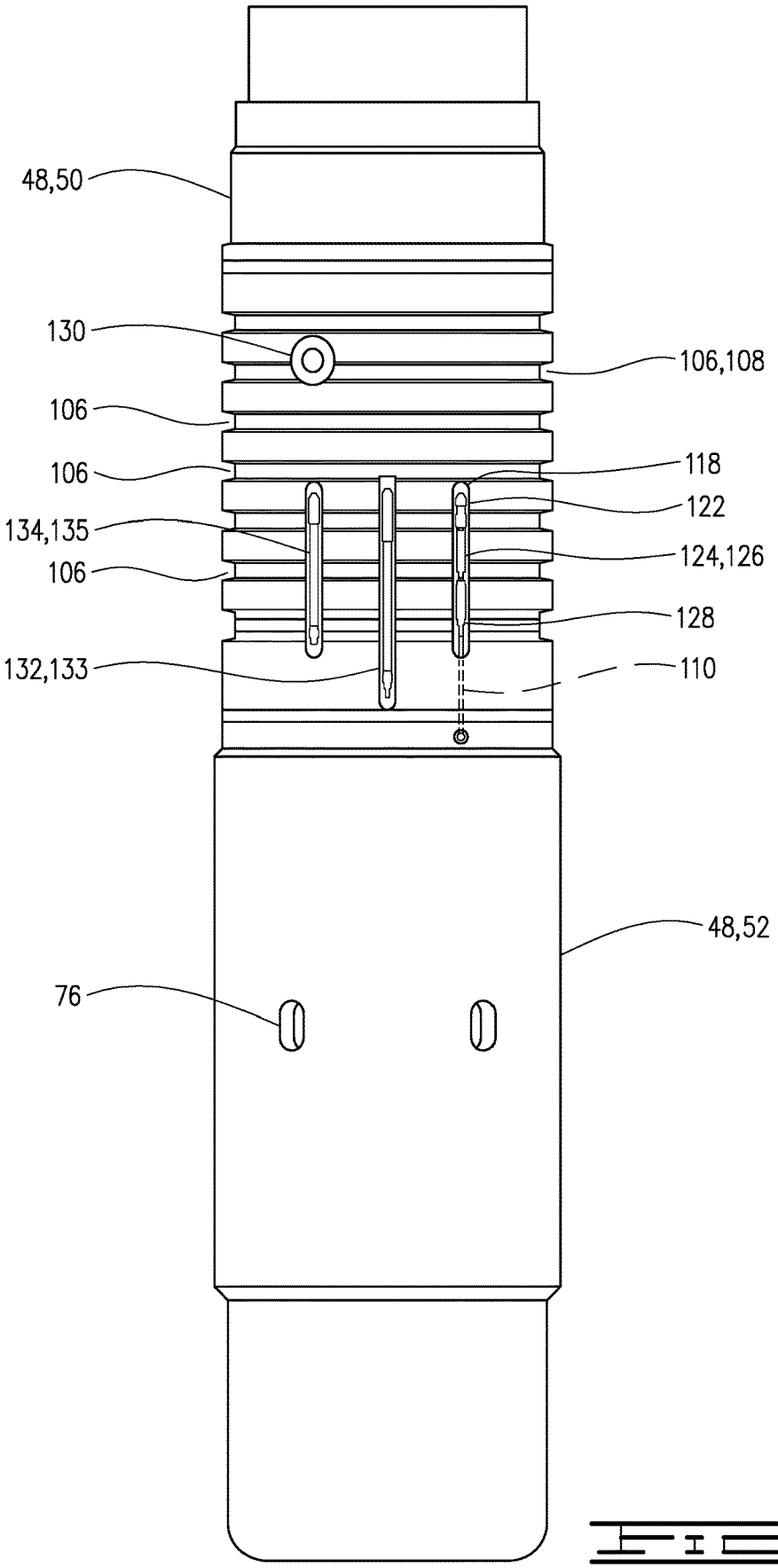
FIG. 5 is a view of the exterior of the outer case of the cementing tool.

Activating assembly 116 may comprise a detonator 122, a pin pusher assembly 124 defining a pin 126 thereon, and a rupture disk 128. The arrangement is shown schematically in FIG. 5 and is well known in the art. A sensor 130 may be positioned in outer case 48 above outer case flow ports 60. Sensor 130 is of a type that will sense the presence of cement in the central flow passage 31. Sensor 130 may be of a type that will recognize a density change for example or other type of sensor. In one embodiment, the sensor 130 is a magnetic sensor that will sense the presence of particles having high magnetic permeability that can be placed in the cement that is displaced into central flow passage 31. The particles may be for example, magnetite or hematite and the sensor 130 will sense the change in magnetic permeability of the cement resulting from the particles placed therein. Cementing tool 10 may also include an electronics/computing package 132 in a pocket 133 and a battery 134 in a pocket 135, both disposed in pockets in outer case 50. Sensor 130 is coupled, either wired or wirelessly, to package 132 which is in turn coupled, either wired or wirelessly, to activating assembly 116.

In operation, cementing tool 10 is lowered into well bore 15 on a casing 32 to a desired location. Cementing tool 10 is in the first, or run-in position 44. In the first position 44, dual stage actuating sleeve 70 prevents flow into central flow passage 31 of cementing tool 10. Specifically, inner sleeve 74 blocks sleeve ports 76 and outer case flow ports 60 to prevent flow therethrough. Once at the desired location, a ball 94 is displaced through casing 32 into cementing tool 10 until it engages seat 92. Pressure is increased to break shear pin 96 and inner sleeve 74 moves downwardly to its second position, to place cementing tool 10 in its second, or cementing position 46. Once tool 10 is in its cementing position, cement is displaced downwardly in annulus 20 through the cement flow path defined by outer case flow ports 60 and sleeve ports 76 into central flow passage 31 of cementing tool 10. Particles with high magnetic permeability may be placed in the cement displaced into the annulus 20. The tool 10 may include a magnet housed near sensor 30, so that when the high magnetic permeability particles pass by the magnet, a change in magnetic permeability occurs in the interior of the cementing tool 10. Sensor 130 will sense a change in magnetic permeability in the interior of the cementing tool 10 when the cement with the high magnetic permeability particles passes thereby in central flow passage 31. The sensor 130 sends signals reflecting magnetic permeability to the package 132, and when the permeability is at a certain level an activating signal is sent from package 132 to activating assembly 116.

The activating signal will activate detonator 122. Detonator 122 will create a small pyrotechnic reaction which will cause pin pusher 124 to move downwardly into rupture disk 128. Rupture disk 128 will rupture opening a pathway from annular fluid filled chamber 84 through passageway 110 to grooves 106 that define relief chamber 108. Fluid will be communicated through pocket 118, and grooves 106 are fluidically connected through pockets 118, 133 and 135. Differential pressure in cementing tool 10 will cause outer sleeve 72 to move upwardly in outer case 50 to move cementing tool 10 to its third position 47. Outer sleeve 72 is its second position when the tool 10, and dual stage actuating sleeve 70 is in the third position 47. In the third position 47, dual stage actuating sleeve, and specifically outer sleeve 72, blocks outer case flow ports 60 to prevent flow therethrough, once cementing is complete. The sensor 130 thus sends a signal that generates the second stage actuation to close the cement flow path from the annulus 20 into the central flow passage 31. Although pin pusher 124 is described as moved by a pyrotechnic reaction, the pin pusher can be driven by other means, such as hydraulic, mechanical, chemical or other type of actuator.

Although the sensor described herein is a magnetic permeability sensor, other types of sensors that will recognize when cement is in central flow passage 31 may be used. For example, sensors that recognize changes in fluid density and/or viscosity may be used. There are other sensor arrangements that may be used as well. For example, transmitters may be placed in the cement. Such transmitters may be, for example, very small micro-electromechanical sensors ("MEMS") or radio-frequency identification ("RFID") tags sized and configured to act as a fluid particle and flow with the cement displaced through the well annulus 20 and into central flow passage 31. Known detectors, or sensors may be used as sensor 130 in such a case. The sensors may comprise MEMS or RFID tag readers depending on the transmitter used. The MEMS or RFID tag readers may communicate either wired, or wirelessly with the activating device 116 to generate the pyrotechnic reaction and causing pin pusher 124 to move downwardly into rupture disk 128. Rupture disk 128 will rupture opening a pathway from annular fluid filled chamber 84 through passageway 110 to grooves 106 that define relief chamber 108.

Example Embodiments

Embodiment 1: A reverse cementing tool comprising an outer case connected in a casing string and a dual stage actuating sleeve disposed in the outer case. The dual stage actuating sleeve is operable in a first stage actuation to open a cement flow path from a well annulus to a central flow passage of the reverse cementing tool and operable in a second stage actuation to close the cement flow path. A poppet valve is connected in the casing below the dual stage actuating sleeve.

Embodiment 2: The tool of Embodiment 1, the dual stage actuating sleeve comprising an outer sleeve disposed in the outer case, the outer sleeve defining a plurality of sleeve ports in the wall thereof communicated in a first position of the tool with outer case ports defined in the outer case, the outer case ports and outer sleeve ports defining the cement flow path between the well annulus and the central flow passage; and an inner sleeve detachably connected in the outer sleeve, the inner sleeve in the first position of the tool covering the outer sleeve flow ports to block the cement flow path and prevent communication from the well annulus to the central flow passage.

Embodiment 3. The tool of Embodiment 2, the inner sleeve movable downwardly to uncover the outer sleeve flow ports and permit flow through the cement flow path from the annulus into the central flow passage in a second position of the reverse cementing tool.

Embodiment 4. The tool of any of Embodiments 2-3, the outer sleeve movable upwardly in the second stage actuation to cover the outer case flow ports and prevent communication from the well annulus to the central flow passage in a third position of the tool.

Embodiment 5. The tool of any of Embodiments 2-4, further comprising a fluid chamber defined between the outer sleeve and the outer case, a relief chamber communicable with the fluid chamber and a rupture disk positioned between the fluid chamber and the relief chamber, the fluid in the fluid chamber communicated with the relief chamber and the outer sleeve movable upwardly to cover the outer case flow ports upon rupturing of the rupture disk.

Embodiment 6. The tool of any of Embodiments 2-5, the inner sleeve defining a ball seat and movable to the second position of the tool after a ball has engaged the ball seat and pressure increased to detach the inner sleeve from the outer sleeve.

Embodiment 7. The tool of any of Embodiments 2-6 further comprising a sensor positioned above the outer case ports configured to detect the presence of cement in the central flow path and to send a signal to generate the second stage actuation.

Embodiment 8. A reverse cementing tool comprising an outer case defining a plurality of outer case flow ports through a wall thereof, an outer sleeve disposed in the outer case, the outer sleeve defining a plurality of outer sleeve flow ports therethrough, the outer sleeve flow ports communicated with the outer case flow ports in a first position of the tool, the outer sleeve flow ports and outer case flow ports defining a cement flow path from a well annulus to a central flow passage of the outer case, an inner sleeve positioned in the outer sleeve to cover the outer sleeve flow ports in the first position of the tool and prevent flow through the cement flow path into the annulus, and the inner sleeve movable in a first direction to uncover the outer sleeve flow ports and permit flow into the central flow passage from the well annulus through the cement flow path in a second position of the tool, and the outer sleeve movable in a second direction opposite the first direction to block flow through the outer case flow ports and prevent communication therethrough from the well annulus in a third position of the tool.

Embodiment 9. The tool of Embodiment 8, the first direction being downward and the second direction being upward.

Embodiment 10. The tool of any of Embodiments 8-9 further comprising a coupling sleeve disposed about the outer case and connectable to a casing, an annular fluid filled chamber defined between the outer sleeve and the outer case, the outer case defining a relief passageway in a wall thereof communicated with the annular fluid filled chamber, a rupturable barrier at an end of the relief passageway, and the coupling sleeve and outer case defining a relief chamber communicated with the relief passageway upon the rupturable barrier being ruptured to receive fluid from the annular fluid filled chamber and permit the outer sleeve to move in the second direction to the third position of the tool.

Embodiment 11. The tool of Embodiment 10, the relief chamber comprising a plurality of grooves defined in the outer case.

Embodiment 12. The tool of any of Embodiments 10-11 further comprising a sensor positioned above the outer case flow ports, and an activating device operably communicated with the sensor and configured to activate and rupture the rupturable barrier when the sensor sends a signal indicating the presence of cement in the central flow passage.

Embodiment 13. The tool of any of Embodiments 8-12, the inner sleeve defining a ball seat thereon, the inner sleeve detachably connected to the outer sleeve in the first position of the tool and movable to the second position upon a ball engaging the ball seat and a predetermined pressure reached thereabove.

Embodiment 14. The tool of any of Embodiments 8-13 further comprising a check valve positioned below the outer case.

Embodiment 15. A reverse cementing tool comprising an outer case, a sleeve assembly disposed in the outer case, the sleeve assembly comprising an outer sleeve; and an inner sleeve detachably connected in the outer sleeve, the sleeve assembly positioned to block a cement flow path from a well annulus to a central flow passage of the outer case in a first position of the tool, the inner and outer sleeves being sequentially movable in opposite directions to permit flow through the cement flow path in a second position of the tool and to block flow through the cement flow path in a third position of the tool.

Embodiment 16. The tool of Embodiment 15, the inner sleeve movable downwardly to place the tool in the second position and the outer sleeve moveable upwardly thereafter to place the tool in the third position.

Embodiment 17. The tool of any of Embodiments 15-16 further comprising a sensor configured to detect the presence of cement in the outer case, and an activation assembly responsive to a signal generated as a result of the sensor indicating the presence of cement and operable to cause the outer sleeve to move upwardly upon receipt of the signal.

Embodiment 18. The tool of any of Embodiments 15-17 the outer sleeve and outer case defining an annular fluid filled chamber therebetween preventing upward movement of the outer sleeve to the third position of the tool, the activating assembly opening a passage to release fluid from the annular fluid filled chamber into a relief chamber and permit upward movement of the outer sleeve.

Embodiment 19. The tool of any of Embodiments 15-18 further comprising a rupturable barrier between the fluid filled chamber and the relief chamber, the activating assembly comprising a pin pusher and a pin operable to rupture the rupturable barrier and release the fluid from the annular fluid filled chamber.

Embodiment 20. The tool of any of Embodiments 15-19 further comprising a poppet valve positioned below the sleeve assembly.

What is claimed is:

1. A reverse cementing tool comprising:

an outer case connected in a casing string;

a dual stage actuating sleeve disposed in the outer case, the dual stage actuating sleeve operable in a first stage actuation to open a cement flow path from a well annulus to a central flow passage of the reverse cementing tool and operable in a second stage actuation to close the cement flow path, the dual stage actuating sleeve comprising:

an outer sleeve disposed in the outer case, the outer sleeve defining a plurality of outer sleeve ports in the wall thereof communicated in a first position of the tool with outer case ports defined in the outer case, the outer case ports and the outer sleeve ports defining the cement flow path between the well annulus and the central flow passage; and an inner sleeve detachably connected in the outer sleeve, the inner sleeve in the first position of the reverse cementing tool covering the outer sleeve ports to block the cement flow path and prevent communication from the well annulus to the central flow passage, the outer sleeve movable upwardly in the second stage actuation to cover the outer case ports and prevent communication from the well annulus to the central flow passage in a third position of the tool; and a poppet valve connected in the casing string below the dual stage actuating sleeve.

2. The reverse cementing tool of claim 1, the inner sleeve movable downwardly in the first stage actuation to uncover the outer sleeve ports and permit flow through the cement flow path from the annulus into the central flow passage in a second position of the reverse cementing tool.

3. The reverse cementing tool of claim 1, further comprising:

a fluid chamber defined between the outer sleeve and the outer case;

a relief chamber communicable with the fluid chamber;

a rupture disk positioned between the fluid chamber and the relief chamber, the fluid in the fluid chamber communicated with the relief chamber and the outer sleeve movable upwardly to cover the outer case ports upon rupturing of the rupture disk.

4. The reverse cementing tool of claim 1, the inner sleeve defining a ball seat and movable to the second position of the tool after a ball has engaged the ball seat and pressure increased to detach the inner sleeve from the outer sleeve.

5. The reverse cementing tool of claim 1, further comprising a sensor positioned above the outer case ports configured to send a signal to generate the second stage actuation.

6. A reverse cementing tool comprising:

an outer case defining a plurality of outer case flow ports through a wall thereof;

an outer sleeve disposed in the outer case, the outer sleeve defining a plurality of outer sleeve flow ports therethrough, the outer sleeve flow ports communicated with the outer case flow ports in a first position of the tool, the outer sleeve flow ports and the outer case flow ports defining a cement flow path from a well annulus to a central flow passage of the outer case;

an inner sleeve positioned in the outer sleeve to cover the outer sleeve flow ports in the first position of the tool and prevent communication between the central flow passage and the annulus through the cement flow path; and the inner sleeve movable in a first direction to uncover the outer sleeve flow ports and permit flow into the central flow passage from the well annulus through the cement flow path in a second position of the tool, and the outer sleeve movable in a second direction opposite the first direction to block flow through the outer case flow ports and prevent communication therethrough from the well annulus in a third position of the tool.

7. The reverse cementing tool of claim 6, the first direction being downward and the second direction being upward.

8. The reverse cementing tool of claim 6 further comprising:

a coupling sleeve disposed about the outer case and connectable to a casing;

an annular fluid filled chamber defined between the outer sleeve and the outer case, the outer case defining a relief passageway in a wall thereof communicated with the annular fluid filled chamber;

a rupturable barrier at an end of the relief passageway; and the coupling sleeve and the outer case defining a relief chamber communicated with the relief passageway upon the rupturable barrier being ruptured to receive fluid from the annular fluid filled chamber and permit the outer sleeve to move in the second direction to the third position of the tool.

9. The reverse cementing tool of claim 8, the relief chamber comprising a plurality of grooves defined in the outer case.

10. The reverse cementing tool of claim 8 further comprising:

a sensor positioned above the outer case flow ports; and an activating device operably communicated with the sensor and configured to activate and rupture the rupturable barrier when the sensor sends a signal indicating the presence of cement in the central flow passage.

11. The reverse cementing tool of claim 6, the inner sleeve defining a ball seat thereon, the outer sleeve detachably connected to the inner sleeve in the first position of the tool and movable to the second position upon a ball engaging the ball seat and a predetermined pressure reached thereabove.

12. The reverse cementing tool of claim 6, further comprising a check valve positioned below the outer case.

13. A reverse cementing tool comprising:

an outer case defining a plurality of outer case ports through a wall thereof;

a sleeve assembly disposed in the outer case, the sleeve assembly comprising:

an outer sleeve defining a plurality of outer sleeve ports therethrough; and an inner sleeve detachably connected in the outer sleeve, the sleeve assembly positioned to block a cement flow path from a well annulus to a central flow passage of the outer case defined by the outer case ports and the outer sleeve ports in a first position of the tool, the inner and outer sleeves being sequentially movable in opposite directions to permit flow through the cement flow path in a second position of the tool and to block flow through the cement flow path in a third position of the tool.

14. The reverse cementing tool of claim 13, the inner sleeve movable downwardly to place the tool in the second position and the outer sleeve moveable upwardly thereafter to place the tool in the third position.

15. The reverse cementing tool of claim 14 further comprising:

a sensor configured to detect the presence of cement in the outer case;

an activation assembly responsive to a signal generated as a result of the sensor indicating the presence of cement and operable to cause the outer sleeve to move upwardly upon receipt of the signal.

16. The reverse cementing tool of claim 15, the outer sleeve and the outer case defining an annular fluid filled chamber therebetween preventing upward movement of the outer sleeve to the third position of the tool, the activating assembly opening a passage to release fluid from the annular fluid filled chamber into a relief chamber and permit upward movement of the outer sleeve.

17. The reverse cementing tool of claim 16, further comprising a rupturable barrier between the fluid filled chamber and the relief chamber, the activating assembly comprising a pin pusher and a pin operable to rupture the rupturable barrier and release the fluid from the annular fluid filled chamber.

18. The reverse cementing tool of claim 13, further comprising a poppet valve positioned below the sleeve assembly.

* * * * *